US007128583B2

(12) United States Patent
Tsuo

(10) Patent No.: US 7,128,583 B2
(45) Date of Patent: Oct. 31, 2006

(54) GROUNDING ELEMENT

(75) Inventor: Chun-Jung Tsuo, Taoyuan County (TW)

(73) Assignee: BENQ Corporation, Taoyuan (TW)

( * ) Notice: Subject to any disclaimer, the term of this patent is extended or adjusted under 35 U.S.C. 154(b) by 0 days.

(21) Appl. No.: 11/209,690

(22) Filed: Aug. 24, 2005

(65) Prior Publication Data

US 2006/0057871 A1 Mar. 16, 2006

(30) Foreign Application Priority Data

Sep. 15, 2004 (TW) ..... 93127847 A

(51) Int. Cl.
*H01R 13/648* (2006.01)

(52) U.S. Cl. ..... 439/92

(58) Field of Classification Search ..... 439/92, 439/95, 101, 108; 361/799
See application file for complete search history.

(56) References Cited

U.S. PATENT DOCUMENTS 2,300,563 A * 11/1942 Gaub ..... 439/92
2,312,002 A * 2/1943 Schmitt ..... 200/51.1
2,414,180 A * 1/1947 Truax ..... 439/92
2,825,010 A * 2/1958 Silverschotz ..... 361/776
2,937,227 A * 5/1960 Selnau ..... 174/84 R
3,122,604 A * 2/1964 Cook et al. ..... 174/51
3,780,209 A * 12/1973 Schuplin ..... 174/51
4,029,384 A * 6/1977 Reinwall, Jr. ..... 439/397
4,795,353 A * 1/1989 Baker ..... 439/92
4,993,959 A * 2/1991 Randolph ..... 439/92
5,192,227 A * 3/1993 Bales ..... 439/532
5,480,310 A * 1/1996 Baum ..... 439/94
5,537,294 A * 7/1996 Siwinski ..... 361/753

* cited by examiner

*Primary Examiner*—Tulsidas C. Patel
*Assistant Examiner*—Vladimir Imas
(74) *Attorney, Agent, or Firm*—Birch, Stewart, Kolasch & Birch, LLP

(57) ABSTRACT

A grounding element attached to a tab having a hole. A spring portion is connected to one side of a bottom of the grounding element and extends in a first direction, and a latching portion is connected to another side of the bottom. When the grounding element is attached to the tab, the spring portion and the latching portion hold edges of the tab.

5 Claims, 5 Drawing Sheets

GROUNDING ELEMENT

BACKGROUND

The invention relates to a grounding element for an electronic device.

Typically, in an electronic device, a circuit board is grounded by electrically connecting the circuit board to a metal housing of the electronic device. The electrical connection is typically achieved by a metal grounding element. In FIG. 1, a conventional grounding element 100 is attached to a metal housing 10 of an electronic device. A tab 12 with a hole 14 on which the grounding element 100 is attached extends from the metal housing 10. A circuit board (not shown) is electrically connected to the metal housing 10 via the grounding element 100.

FIG. 2 depicts the structure of the conventional grounding element 100. The grounding element 100, formed by bending a metal plate, comprises a spring portion 110 and a bottom 120. The bottom 120 is planar. When the grounding element 100 is attached to the tab 12, the bottom 120 abuts the tab 12, and the spring portion 110 expands to abut the front of circuit board thereby maintaining a reliable electrical connection.

A protrusion 130 is further disposed on the bottom 120 and comprises an inclined surface 132 and an opening 134 adjacent to the inclined surface 132 and the bottom 120. When the grounding element 100 is attached to the tab 12 in the direction indicated by arrow A, the inclined surface 132 allows the protrusion 130 to be easily inserted into the hole 14, and edges of the opening 134 abut an inner wall of the hole 14 to prevent separation of the grounding element 100.

Although the protrusion 130 prevents separation of the grounding element 100, the protrusion 130 can still easily escape from the hole 14 causing separation of the grounding element 100 when the spring portion 110 deformed in the direction indicated by arrow B.

SUMMARY

A grounding element according to an embodiment of the invention comprises a bottom, a spring portion connected to one side of the bottom extending in a first direction, and a latching portion connected to another side of the bottom, wherein when the grounding element is assembled on a tab of a metal housing, the spring portion and the latching portion hold edges of the tab.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

Figure 1:
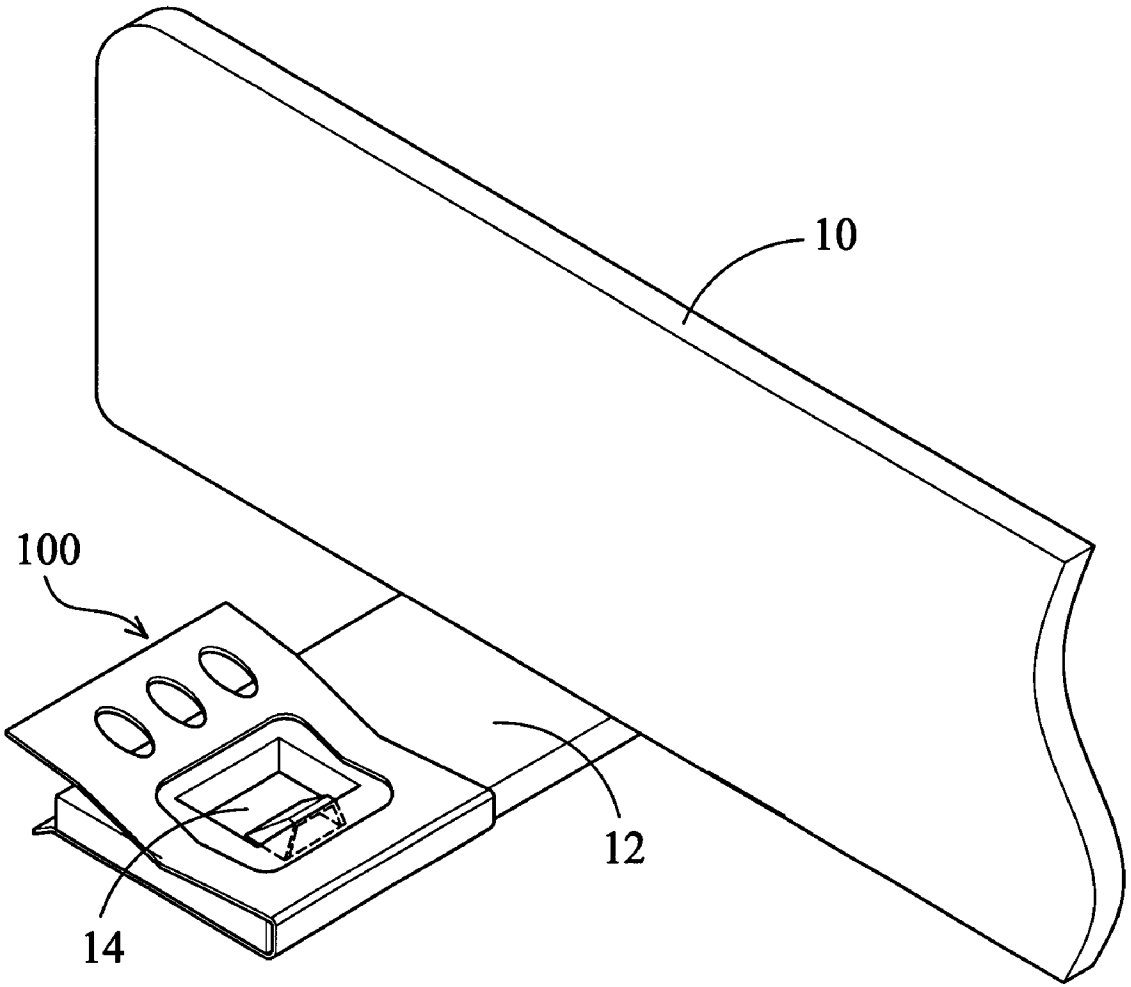
FIG. 1 ( RELATED ART )
FIG. 1 is a perspective view depicting a conventional grounding element attached to a housing of an electronic device.
Figure 2:
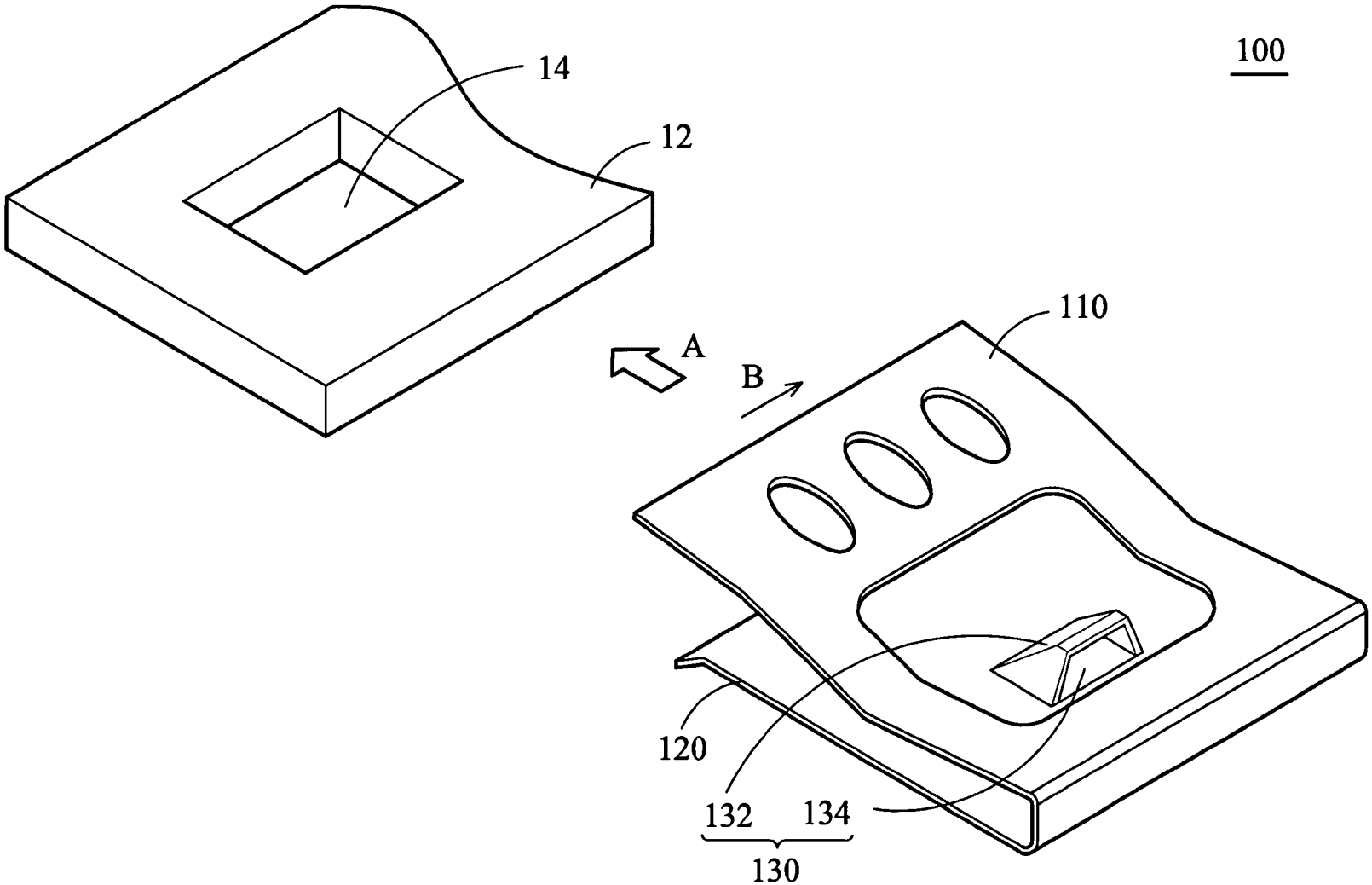
FIG. 2 ( RELATED ART )
FIG. 2 is a perspective view of a conventional grounding element.
Figure 3:
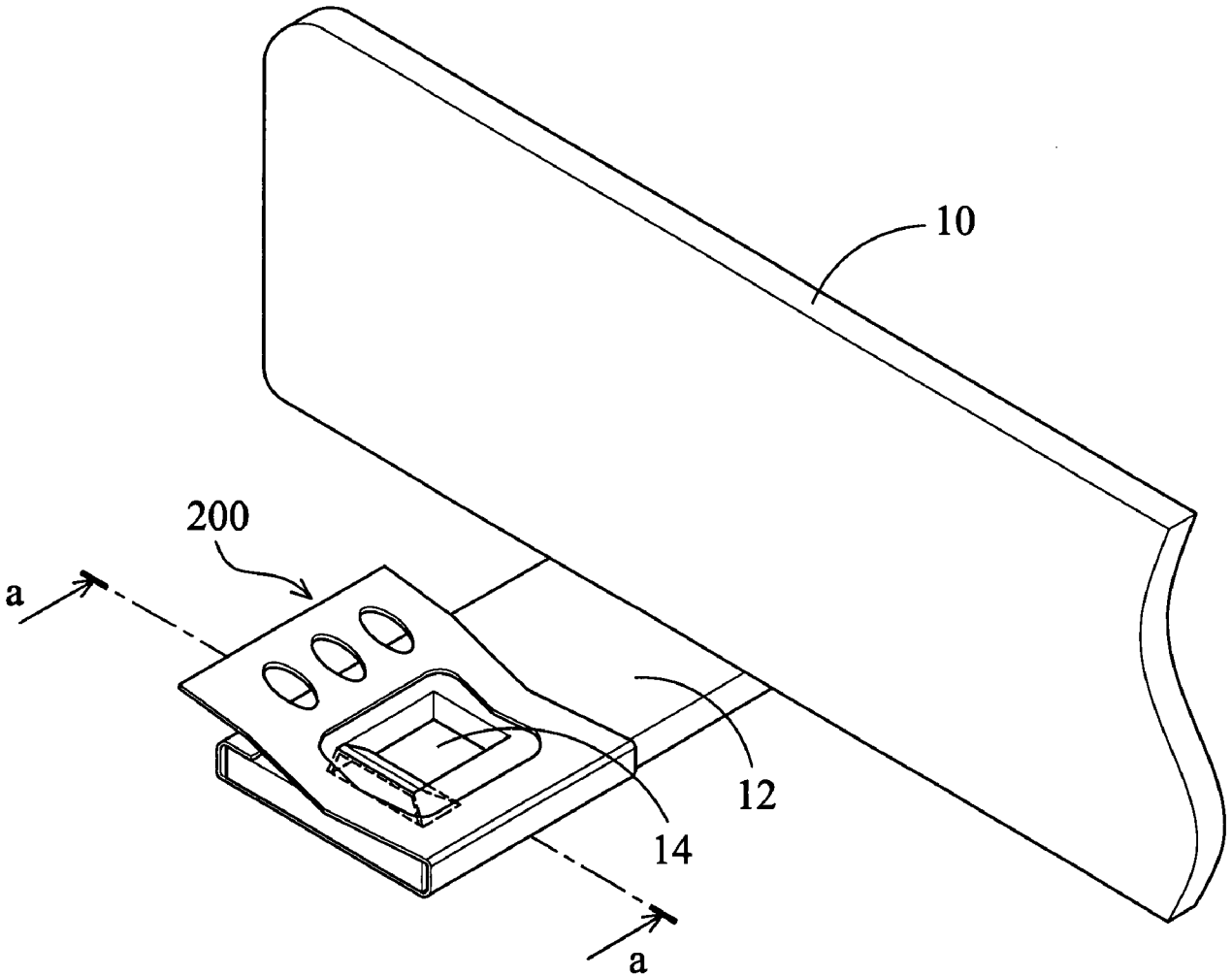
FIG. 3 is a perspective view depicting a grounding element according to an embodiment of the invention attached to a housing of an electronic device.
Figure 4:
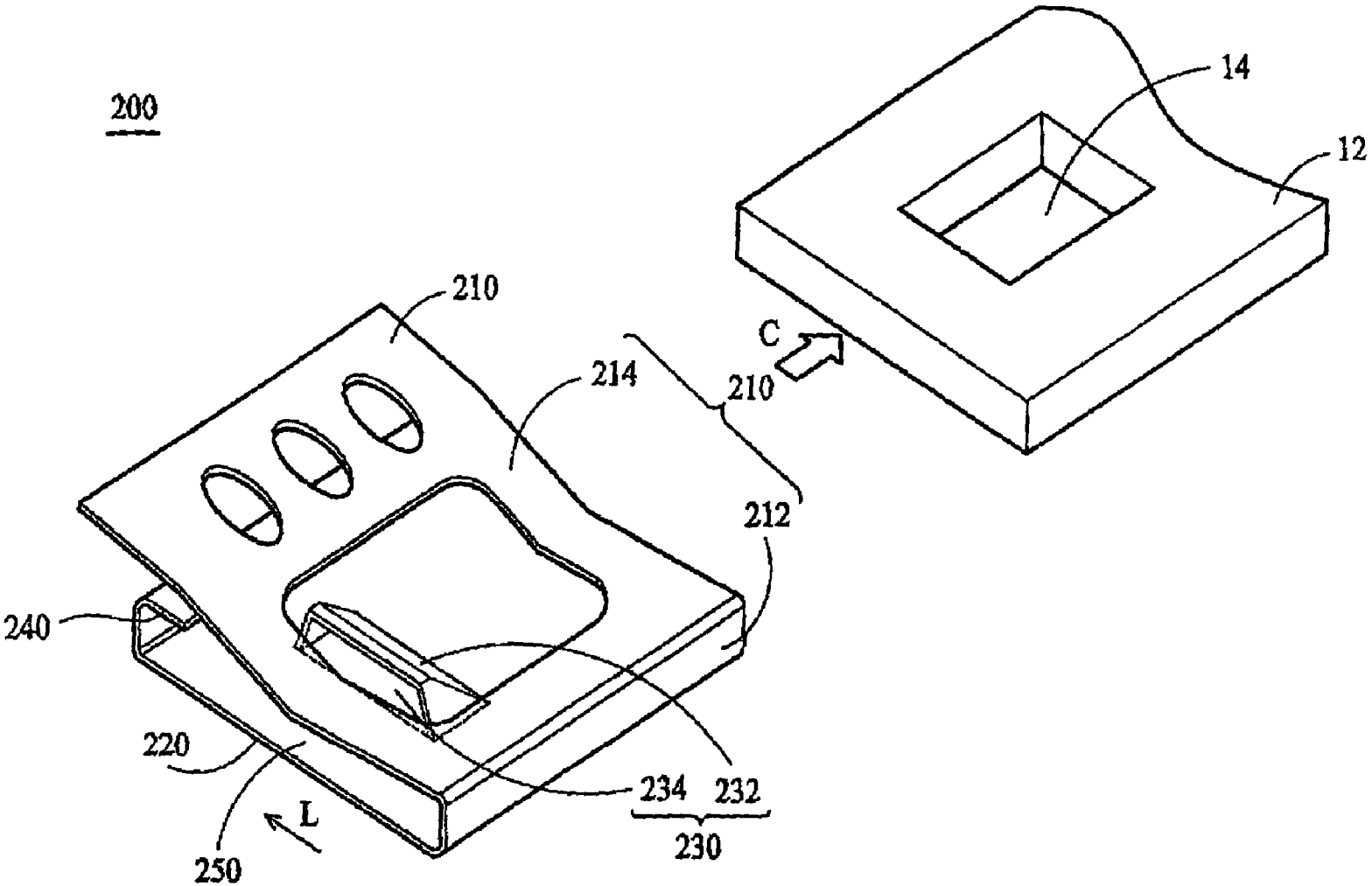
FIG. 4 is a perspective view of a grounding element according to an embodiment of the invention.

Referring to FIG. 3, a grounding element 200 is attached to a tab 12 of a metal housing 10. In FIG. 4, the grounding element 200 comprises a spring portion 210, a bottom 220 and a latching portion 240. The spring portion 210 comprises an upward portion 212 connected to one side of the bottom 220 and an extending portion 214 substantially extending in a first direction L. The latching portion 240 is connected to another side of bottom 220 and extends upward with parallel to the upward portion 212. In this embodiment, the latching portion 240 and the bottom 220 are configured in a U shape. A passage 250 is defined by the latching portion 240 and upward portion 212 with a width substantially equal to the size of the tab 12. When the grounding element 200 is assembled to the tab 12, the passage 250 moves along an assembly direction C to hold the tab 12. The grounding element 200 further comprises a protrusion 230 including an inclined surface 232 and an opening 234 adjacent to the inclined surface 232 and the bottom 220. The protrusion 230 disposed on the bottom and substantially upward extending parallel to the upward portion 212 and the latching portion 240. The opening 234 is perpendicular to the first direction L.

When the grounding element 200 is attached to the tab 12 in the direction indicated by arrow C, the inclined surface 232 allows easy insertion of the protrusion 230 into the hole 14, and edges of the opening 234 abut an inner wall of the hole 14 preventing separation of the grounding element 200. The spring portion 210 and latching portion 240 hold edges of the tab 12, thus, even if the spring portion 210 is pulled and deformed, the latching portion 240 will still hold the tab 12. As the opening 234 abuts the hole 14 in a direction opposite to that indicated by arrow C, the grounding element 200 is held on the tab 12.

Figure 5:
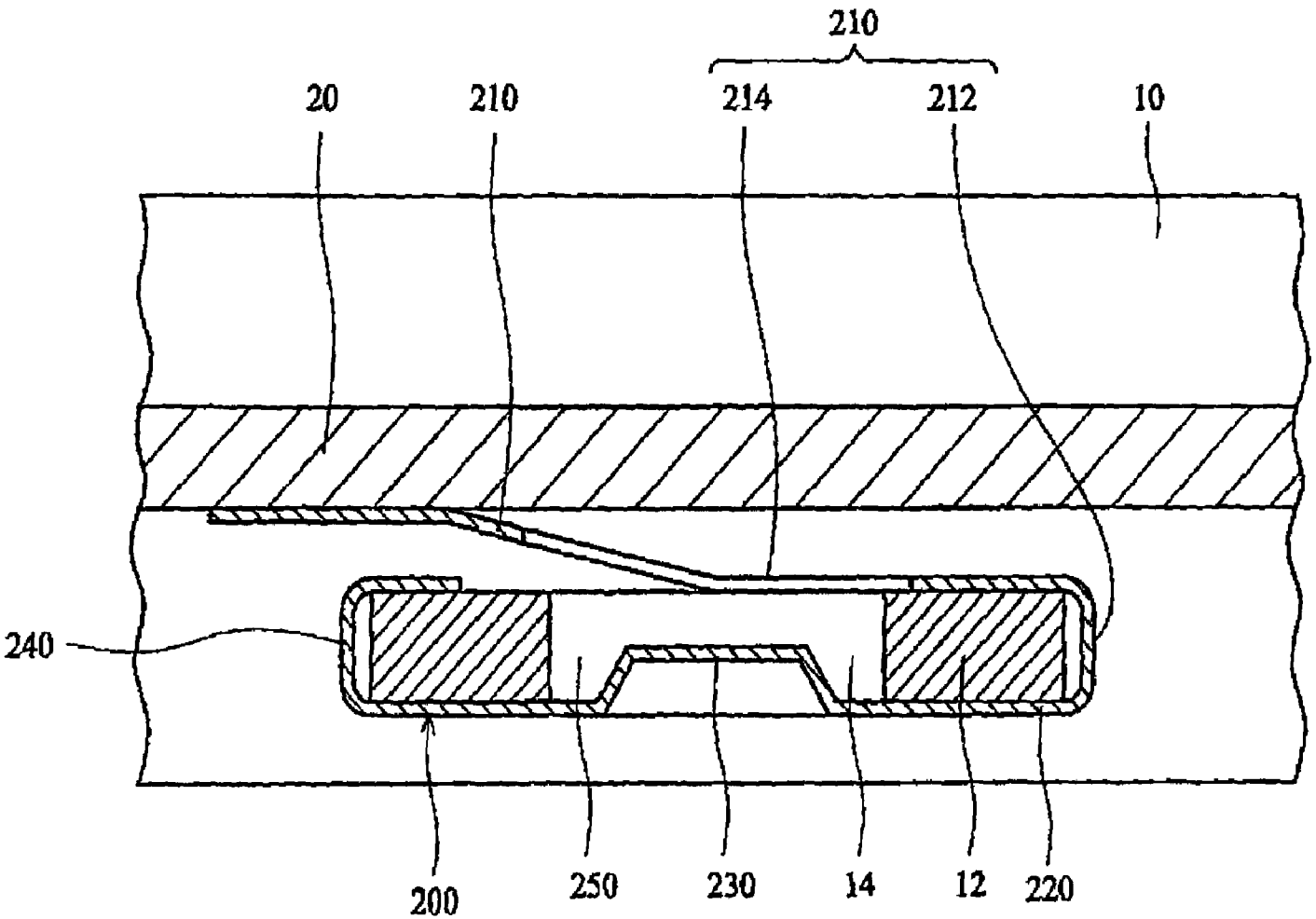
FIG. 5 is a cross section of FIG. 3 along line a—a.

In FIG. 5, a circuit board 20 is electrically connected to the metal housing 10 via the grounding element 200.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A grounding element attached in an assembly direction to a tab comprising:

a bottom;

a spring portion having an upward portion connected to one side of the bottom and an extending portion extending in a first direction;

a latching portion connected to another side of the bottom, extending upward with parallel to the upward portion, wherein a passage is defined by the latching portion and upward portion with a width substantially equal to the size of the tab; and a protrusion disposed on the bottom and extended upward with parallel to the upward portion and the latching portion and comprising an inclined surface, wherein when the grounding element is assembled to the tab, the passage moves along the assembly direction, and the protrusion is inserted into the hole tab and the spring portion and the latching portion hold edges of the tab.

2. The grounding element as claimed in claim 1, wherein the latching portion connected to the bottom is configured in a U shape.

3. The grounding element as claimed in claim 1, wherein spring portion, the latching portion and the bottom are integrally formed.

4. The grounding element as claimed in claim 1, wherein the protrusion comprises an opening adjacent to the bottom and perpendicular to the first direction, and when the grounding element is attached to the tab, edges of the opening abut an inner wall of the hole.

5. The grounding element as claimed in claim 1, wherein the first direction is perpendicular to the assembly direction.

* * * * *